United States Patent [19]

Wolf

[11] 4,043,406

[45] Aug. 23, 1977

[54] CHANCE DEVICE FOR BOARD RACING GAME

[76] Inventor: Tobin Wolf, 285 Aycrigg Ave., Passaic, N.J. 07055

[21] Appl. No.: 595,328

[22] Filed: July 11, 1975

[51] Int. Cl.[2] ..... A63F 9/00; A63H 13/20

[52] U.S. Cl. ..... 273/138 R; 272/31 R; 273/134 B; 273/134 CA

[58] Field of Search ..... 273/86 H, 134 CA, 138 R, 273/138 A; 272/31 R

[56] References Cited

U.S. PATENT DOCUMENTS

| | | | |
|---|---|---|---|
| 1,636,864 | 7/1927 | Keppner | 272/31 R |
| 1,811,543 | 6/1931 | Gavlak | 272/31 R |
| 2,108,726 | 2/1938 | Rocuskie | 272/31 R |
| 2,551,806 | 5/1951 | McKeever | 273/86 B |
| 2,674,457 | 4/1954 | Rago | 272/31 R X |
| 2,874,513 | 2/1959 | Connell | 272/31 R X |
| 3,103,360 | 9/1963 | Miller et al. | 273/86 B |
| 3,589,060 | 6/1971 | Genin | 272/31 R X |

*Primary Examiner*—Anton O. Oechsle
*Attorney, Agent, or Firm*—Jay M. Cantor

[57] ABSTRACT

A game which can be played by two or more people wherein a circular racetrack is provided having a plurality of lanes, each lane having the same number of segments therein positioned about each lane. A toy vehicle is made to traverse the track in a circular manner but having randomly variable radial movement during the traversal of the track so that it traverses all of the lanes on the track in the random manner. The players each control a stationary racing vehicle which is placed in one of the segments at the starting line and is moved forward one space by the player each time the randomly movable racing car passes the stationary racing vehicle without colliding thereinto. The randomly movable vehicle is provided with such random movement by attaching a wire to the vehicle, the wire being journaled in a boss which is positioned on a lever which moves in response to the rotary movement of a cam having an irregular cam surface. The entire cam and lever mechanism is positioned on a platen which rotates in a circular manner. In this manner, the randomly movable vehicle is made to rotate in a circular path about the track by the movement of the platen and to move radially in an eccentric path due to movement of the cam which controls the lever and wire connected to the vehicle.

16 Claims, 3 Drawing Figures

Fig. 3
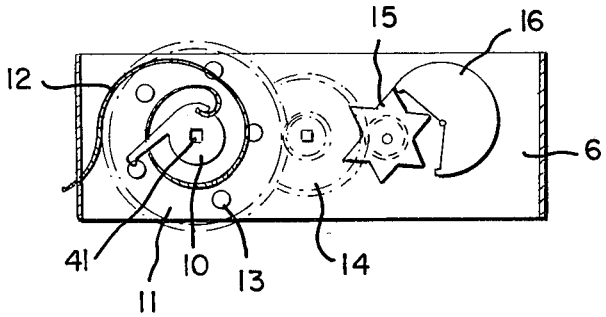
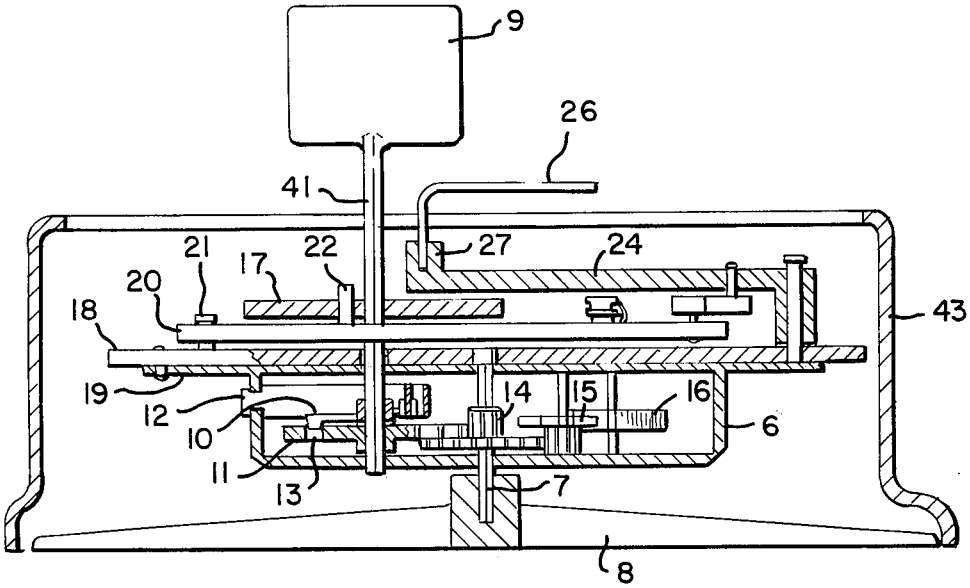
Fig. 2

CHANCE DEVICE FOR BOARD RACING GAME

This invention relates to a game utilizing a mechanism which provides random radial movement to a vehicle, and more specifically, to a mechanism which provides circular as well as random horizontally radial movement to a vehicle while moving in the circular path, all movements taking place in a single plane.

It is necessary for use in a game that there is provided a gameboard wherein a vehicle, rotating about the center of the board, is capable of a monoplanar rotary as well as random radial movement throughout its path. It is also necessary that this gameboard be provided with a relatively simple and inexpensive motive providing mechanism.

In accordance with the present invention, there is provided a simple and inexpensive mechanism which is capable of providing rotary motion as well as random motion in a horizontal direction in a single plane along the rotary path. Briefly, this is accomplished by providing a flat gameboard in the form of a racetrack of preferably circular shape having a plurality of concentric lanes thereon. A plurality of lines extending radially from the center of the circle including the track is provided so that each of the lanes is broken up into a plurality of segments, each lane having the same number of segments. One of the radial lines is marked as a starting position for the racing game. A motive mechanism is provided in the center region of the gameboard within each of the lanes, the motive mechanism providing a rotary as well as random radial motion to a movable vehicle. The vehicles operated by the game players are stationary and positioned within the segments formed by the lane lines and radial lines in accordance with game rules. The driven vehicle is driven by means of the motive mechanism which includes a cam having an irregular cam surface, the cam driving a cam follower which in turn controls a lever, the lever controlling a wire which provides random radial motion to the controlled vehicle in accordance with the irregular shape of the camming surface. The entire cam and lever mechanism is positioned on a platen, the platen being mounted for rotary movement about a shaft whereby the cam and levers rotate along with the platen. The rotary motion provided to the cam and the platen are provided by a normal or standard spring motor, the spring being wound by a key having a shape identical with an aperture in both the cam and the ratchet. In this manner, as the spring of the spring motor unwinds, the key is rotated and thereby rotates the cam as well as causing the platen to rotate by means of a gearing arrangement controlled also by the spring motor. The entire spring motor mechanism is mounted through an intermediate shaft which is part of the motor gearing arrangement into a base for the entire game mechanism.

It is therefore an object of this invention to provide an inexpensive apparatus for providing circular and random radial motion simultaneously.

It is a further object of this invention to provide a game mechanism having a key wound spring motor wherein operation of the spring motor provides a rotary movement of a cam driven by the spring motor around a central fixed gear, rotation of the key during the unwinding process also causing a cam having an irregular camming surface to be rotated, the irregular surface driving a cam follower which in turn drives a follower lever and drive lever to impart radial motion to a wire driving a movable vehicle.

The above objects and still further objects of the invention will immediately become apparent to those skilled in the art after consideration of the following preferred embodiment thereof, which is provided by way of example and not by way of limitation wherein:

FIG. 2 is a side view of the motive mechanism of FIG. 1 with the cover positioned thereon; and FIG. 3 is a top view of the spring motor used in accordance with the present invention.

Figure 1:
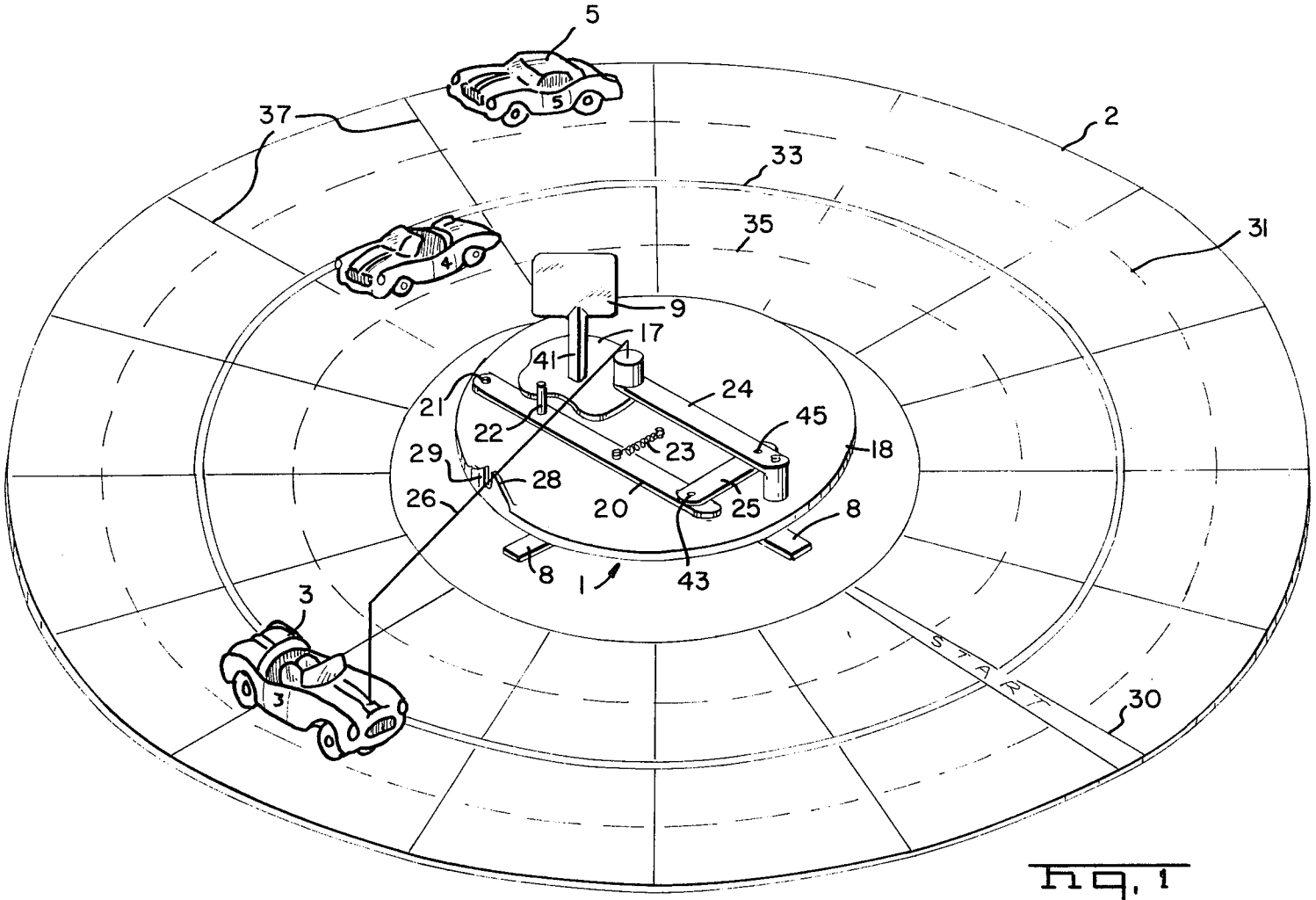
FIG. 1 is a top view of the gameboard of the present invention with the cover of the motive mechanism removed.

Referring now to FIG. 1, there is shown the motive mechanism 1. The gameboard 2 includes a plurality of circular lanes formed by the lines 31, 33 and 35. Each of the lanes is broken up into segments by radial 37, there being an equal number of segments in each of the lanes. The motive mechanism 1 is positioned at the center of the gameboard 2 within all of the lanes. Positioned on the gameboard are a pair of stationary cars 4 and 5 and a car 3 which is movable in a random path by the motive mechanism 1 as will be described in more detail hereinbelow. One of the radial lines 39 is designated as the start position at which point the cars 4 and 5 will be at the start of a game.

Referring now to FIGS. 1 through 3, the motive apparatus which is shown as 1 in FIG. 1 will be described in greater detail. The motive apparatus includes a conventional spring motor 6 (FIGS. 2 and 3) mounted by the intermediate shaft 7 in the base 8 which is secured at the central region of the gameboard 2 as shown in FIG. 1. The intermediate shaft 7 is secured in the base 8 against rotation therein. The spring motor includes a winding key 9 having a shaft 41 with a square cross-section which fits snuggly into a square hole in the ratchet lever 10 to provide rotation therewith, but is journaled in a round hole in the drive gear 11. The shaft 41 is also positioned in a square hole in the cam 17 to provide rotation thereto. Thus, when the key 9 is turned in a clockwise direction, the spring 12 is wound as the ratchet lever slips past the holes 13 in the drive gear 11, but the drive gear remains stationary. As the spring unwinds, the ratchet lever engages one of the holes 13 in the drive gear 11, causing it to turn. Intermediate shaft 7 has a square cross-section and can not turn in the base 8 or in the intermediate gear 14. The drive gear 11 engages the intermediate gear 14 and, since the intermediate gear can not turn, the drive gear and hence the entire spring motor must revolve about the axis of shaft 7. The star-wheel 15 and the escapement lever 16 serve to regulate the speed of the motor in well known manner. As noted above, as the platen 18 rotates about shaft 7 under the power of the motor spring 12, the spring unwinds, thereby rotating the key 9 secured in cam 17 and causing the cam to rotate.

The platen 18 is fastened to the mounting plate 19 of the spring motor and the cam follower lever 20 is pivotally mounted to the platen by the pivot pin 21. The cam follower 22 is fastened to the lever 20. The cam follower is held in contact with the irregular rotating cam surface of the cam 17 by the spring 23 which is secured to the platen 18 and lever 20. The movement of the cam follower is transmitted to the drive lever 24 by the link 25 and the cam follower lever 20 via pivots 43 and 45. The stiff wire 26 is journaled in the boss 27 on the lever 24 and hooks into the driven vehicle 3. The wire 26 is guided between the ribs 28 and 29 as it is driven in a circular path by the rib 29 on the rotating platen 18. Thus, the greatly magnified movement of the cam folower 22 is transmitted to the drive vehicle as an erratic or random movement traversing all four lanes of the racetrack.

In actual operation, a cover 43 (FIG. 2) will be positioned over the entire mechanism 1 with only the key 9, ribs 28 and 29, and wire 26 extending therethrough, thereby preventing the possibility of a player anticipating movement of the car 3 from viewing of the cam 17. Also to eliminate the possibility that a player will begin to anticipate the movements of the car 3 from the use of a single cam 17, provision may be made for replacement or changing of the cam 17 so that the player or players will not be aware of what movements the car 3 will take.

In actual operation, each player will place his car in one of the segments at the start line 39 and the key 9 will be rotated to wind up the spring motor. The car 3 will then move in a path around the track, moving randomly from lane to lane in accordance with the operation of the cam 17 and the cam follower and magnification system driven thereby. Each time the car 3 passes one of the vehicles 4 and 5 without a collision, the player can advance the car to the next segment, positioning the car in any one of the lanes within the next pair of radial lines 37. In the event of a collision, the cars 4 or 5, whichever suffers the collision, is forced to retreat a set number of segments in accordance with a predetermined game policy. The first car to cross the start line after completely encircling the track is declared the winner.

Though the invention has been described with respect to a specific preferred embodiment thereof, many variations and modidications will immediately become apparent to those skilled in the arts. It is therefore the intention that the appended claims be interpreted as broadly as possible in view of the prior art to include all such variations and modifications.

What is claimed is:

1. A device for providing simultaneous circular and random radial action in a single plane to a toy which comprises, a. a platen,
b. a base,
c. a toy,
d. a motor,
e. means secured to said base forming a first axis and first means rotatable about said first axis under power of said motor to rotate said platen about said first axis,
f. second means rotatable about a second axis different from said first axis,
g. third means coupled to said first and second means for rotating said second means, and
h. means including said platen responsive to rotation of said first and second means coupled to said toy to provide said circular and random radial movement in a single plane to said toy in said plane.

2. A device as set forth in claim 1 wherein said motor includes a spring and said third means includes a key for winding said key having a predetermined cross-section, said second means having an aperture having substantially the same cross-section as said key, said key passing through said aperture.

3. A device as set forth in claim 2 wherein said first means in a drive gear having an axis of rotation, and said means secured to said base including a gear shaft fixed to said base and having an intermediate gear thereon meshing with said drive gear, said device further including means to control the speed of rotation of said drive gear about said gear shaft, said drive gear having plural apertures, and a ratchet finger positionable in one of said apertures, said key being secured to said ratchet finger at the axis of said ratchet finger for driving said drive gear.

4. A device as set forth in claim 3 wherein said key has a polygonal cross-section.

5. A device as set forth in claim 4 wherein said second means is a cam having a randomly irregular camming surface and said means responsive includes a cam follower contacting said camming surface, means to multiply the movements of said cam follower and wherein said means coupled to said toy is also coupled to said means to multiply for providing said random radial circular movement to said toy.

6. A device as set forth in claim 5 wherein said means coupled to said toy includes a stiff wire coupled to said means to multiply, said platen including a pair of adjacent ribs, said wire passing between said ribs.

7. A device as set forth in claim 3 wherein said second means is a cam having a randomly irregular camming surface and said means responsive includes a cam follower contacting said camming surface, means to multiply the movements of said cam follower and wherein said means coupled to said toy is also coupled to said means to multiply for providing said random radial and circular movement to said toy.

8. A device as set forth in claim 7 wherein said means coupled to said toy includes a stiff wire coupled to said means to multiply, said platen including a pair of adjacent ribs, said wire passing between said ribs.

9. A device as set forth in claim 2 wherein said key has a polygonal cross-section.

10. A device as set forth in claim 1 wherein said first means includes a drive gear having an axis of rotation, a gear shaft fixed to said base and having an intermediate gear thereon meshing with said drive gear, and means to control the speed of rotation of said drive gear about said gear shaft.

11. A device as set forth in claim 19 wherein said third means has a polygonal cross-section.

12. A device as set forth in claim 1 wherein said third means has a polygonal cross-section.

13. A device as set forth in claim 12 wherein said second means is a cam having a randomly irregular camming surface and said means responsive includes a cam follower contacting said camming surface, means to multiply the movements of said cam follower and wherein said means coupled to said toy is also coupled to said means to multiply for providing said random radial and circular movement to said toy.

14. A device as set forth in claim 13 wherein said means coupled to said toy includes a stiff wire coupled to said means to multiply, said platen including a pair of adjacent ribs, said wire passing between said ribs.

15. A device as set forth in claim 1 wherein said second means is a cam having a randomly irregular camming surface and said means responsive includes a cam follower contacting said camming surface, means to multiply the movements of said cam follower and wherein said means coupled to said toy is also coupled to said means to multiply for providing said random radial circular movement to said toy.

16. A device as set forth in claim 15 wherein said means coupled to said toy includes a stiff wire coupled to said means to multiply, said platen including a pair of adjacent ribs, said wire passing between said ribs.

* * * * *